United States Patent [19]

Towns et al.

[11] Patent Number: 4,793,503

[45] Date of Patent: Dec. 27, 1988

[54] CONTAINER CLOSURE WITH RUPTURABLE TAMPER DISK

[75] Inventors: Edward J. Towns, Convent Station; Edward M. Brown, Livingston, both of N.J.

[73] Assignee: TBL Development Corporation, Livingston, N.J.

[21] Appl. No.: 450,531

[22] Filed: Dec. 17, 1982

[51] Int. Cl.[4] ..... B65D 53/04

[52] U.S. Cl. ..... 215/250; 206/807; 215/350; 220/214; 220/258; 220/278; 220/377

[58] Field of Search ..... 215/203, 209, 211, 213, 215/214, 219, 220, 230, 232, 247, 250, 252, 257, 258, 329, 341, 343, 344, 347, 349, 350, 351, 348, 365, 366; 116/200, 212, 306, 307; 73/762; 49/13; 220/214, 258, 304, 359, 277

[56] References Cited

U.S. PATENT DOCUMENTS

| | | | |
|---|---|---|---|
| 603,151 | 4/1898 | Norton . | |
| 810,334 | 1/1906 | Green . | |
| 939,602 | 11/1909 | Landon . | |
| 1,095,313 | 5/1914 | Davids . | |
| 1,916,977 | 7/1933 | Gutmann | 215/329 |
| 2,068,389 | 1/1937 | Smith | 215/350 |
| 2,090,555 | 8/1937 | Sharp . | |
| 2,131,774 | 10/1938 | Waring | 215/250 |
| 2,131,775 | 10/1938 | Waring | 215/250 |
| 3,489,307 | 1/1970 | Wenger | 215/351 X |
| 3,501,042 | 3/1970 | Risch et al. | 215/232 |
| 3,612,325 | 10/1971 | Williams | 215/350 X |
| 3,692,199 | 9/1972 | Mumford | 215/220 |
| 3,826,221 | 7/1974 | Ross . | |
| 3,896,959 | 7/1975 | Roy | 215/350 X |
| 3,899,295 | 8/1975 | Halpern . | |
| 3,923,198 | 12/1975 | Brochman | 220/359 |
| 4,038,746 | 8/1977 | Bromley | 220/277 X |
| 4,069,935 | 1/1978 | Hampel | 215/203 |
| 4,381,840 | 5/1983 | Ostrowsky | 215/329 |
| 4,456,139 | 6/1984 | Kent | 215/252 |
| 4,461,389 | 7/1984 | Korn | 215/246 |

*Primary Examiner*—Stephen Marcus
*Assistant Examiner*—Bryon Gehman
*Attorney, Agent, or Firm*—Robin, Blecker & Daley

[57] ABSTRACT

A container closure includes a closure member defining container closing expanse, a tamper-indicating element in the closure interiorly of the closure member and tines movable with the closure member for both retaining the tamper-indicating element with the closure and for selectively tearing the tamper-indicating element. The movable tines are inaccessible through the closing expanse of the closure member and the closure affords visibility therethrough of the condition of the tamper-indicating element.

The tamper indicating element includes a compressible foam layer and the movable tines reside essentially in the foam layer.

25 Claims, 3 Drawing Sheets

CONTAINER CLOSURE WITH RUPTURABLE TAMPER DISK

FIELD OF THE INVENTION

This invention relates generally to containers of tamper-indicating type and pertains more particularly to closures providing containers with tamper indication.

BACKGROUND OF THE INVENTION

Recent domestic events have heightened the need for an effective manner in which to assure the uncontaminated delivery of contained products to a consumer, particularly medicinal products taken internally. Specifically needed is a container for such products which bear assuring indication to the consumer that the contents have not been tampered with from their point of manufacture to the point of consumer sale.

A fundamental prior art approach toward meeting this need is seen in the so-called "telltale" indication, i.e., a readily discernible characteristic indicative of tampering, such as a signal that some person has previously attempted to gain access to the container contents. Broadly speaking, this approach can be generalized as placing a tamper-indicating member in the path of access to a container to indicate tampering by discernible change. Categorizing telltale types, one finds in the prior art approaches elements which evidence color change, which mechanically present literal messages, and which are ruptured or torn upon the occurrence of tampering. The color change devices may be considered less than desirable as requiring ambient-sensitive constituents and measures for sealing same from ambient environment. The mechanical devices providing literal indication, i.e., the words "closed" or "open", are less than desirable as they are inherently complex and customized. Of the three categories, the rupturing and tearing practice offers the best potential for desired simplicity in solution.

Prior art telltales may also be categorized in respect of the relative location of the telltale to the container access port. Here, one finds efforts in which the telltales are located directly at the access port and wherein the telltale are otherwise located in the path of access to the container. In the former locational practices, telltales directly span the access opening, e.g., are secured across the mouths of jars. In the latter, the telltales are located in container wrappers, within plastic heat shrunk about the capped jar, etc. Clearly, the effective location for a telltale is directly at the access port, since wrappers, heat shrunk plastic sleeves and like telltale items outside the container may be removed and the remaining capped container remain without tamper indication.

Further, prior art telltale indication may be categorized as of type wherein the telltale directly at the access opening is closure member activated or not. In the former category, reverse sense (opening) movement of the closure member brings some element into tearing relation with the telltale. In the latter case, the telltale is unaffected by closure member removal. Clearly, the closure member activated case affords greater security.

Specific prior art patents depicting the foregoing practices are identified and discussed in detail in the statement pursuant to 37 CFR 1.97 and 1.98 filed herein.

Of such prior art patents, U.S. Waring U.S. Pat. Nos. 2,131,774 and 2,131,775 are considered to disclose tamper-indicating containers incorporating the desired of the foregoing categories of tamper indication. In these containers, the tamper-indicating element is simple rupturable sheet material. The element is located directly at the container mouth opening and is cap-activated. In accomodating this operative selection of features, however, Waring has vulnerability, recognized expressly in the patents, to direct tampering with the telltale element.

The Waring U.S. Pat. No. 2,131,774 practice is to provide a cap in the form of a hollow cylinder having a skirt depending from the cap top and interiorly threaded to receive the jar neck. The cap top is centrally open and prongs are formed in the plane of the cap extending into the central opening. The telltale element is nested in the cap interior and suitably secured therein. The cap with its nested telltale is then rotated into secured relation with the jar. Now the prongs are bent out of the plane of the cap top and into puncturing relation with the telltale element, remaining accessible through the open cap top.

In commenting on this aspect of his capped container, Waring states that if one tampers with the prongs, i.e., by bending same out of such ruptured relation with the telltale element, the consumer can detect such tampering by observing the state of the prongs said to be deformed on reinsertion and by observing the state of the telltale element said to be thus marred. Such ultimate reliance on demanding observations by the consumer renders the Waring approach less than desirable, despite its inclusion of the most effective of the outlined practices. Its shortcoming indicates still another essential to effective tamper indication, namely, that the rupturing elements and telltale must be maintained inaccessible.

In related considerations, applicants see as highly desirable characteristics of effective tamper indication such matters as equipping closure members with complete tamper-indicating capability at the point of their manufacture, enabling them to be made without customized cap structure or cap-working steps as in the Waring approach, and as adapted for use with the widespread varieties of caps currently in production.

In pending commonly-assigned U.S. patent applications Ser. No. 441,109 filed on Nov. 12, 1982 and entitled "Container with Tamper Indication and Method for Providing Same" and Ser. No. 443,608 filed on Nov. 22, 1982 and entitled "Tamper-Indicating Closure for a Container, Container and Method for Making Same", apparatus and methods are provided for accomodating the foregoing practice selections and having characteristics also accomodating such existing industrial practices in the related industries.

In these applications a container closure is provided having a closure member defining container closing expanse, a tamper-indicating element in the closure interiorly of the closure member and means movable with the closure for both retaining the tamper-indicating element with the closure and for selectively rupturing the tamper-indicating element, such means being inaccessible through the closing expanse of the closure member and the closure affording visibility exteriorly thereof of the condition of the tamper-indicating element. In a typical jar container embodiment in accordance with the Ser. No. 443,608 application, the closure comprises a cap having a disc-shaped rupturable telltale interiorly of the cap depending skirt and telltale retaining-rupturing means extending from the upper cap interior downwardly into securement with the telltale disc, such means being movable with the cap in the course of its rotative movement. Upon first sense closure movement into releasable securement with a jar neck, the entirety of the closure rotates in unison. At the end of such first sense movement, an adhesive upon the jar adjacent its mouth engages the telltale disc. Second sense closure movement to open the container gives rise to the selective activity of the retaining-rupturing means, i.e., the cap and such means move in unison relative to the now jar-secured telltale, disrupting the integrity thereof, as would be visible to a consumer through a transparent or translucent cap.

The Ser. No. 443,608 application also contemplates maintaining the contents of a container further secure from ambient environment by securing to the margin of the telltale after its securement to the retaining-rupturing means, a sealing layer which is in turn sealed to the container access port. Thus, there results a closure having the customary glassine sealing wafer visible from the underside of the closure, but with a telltale system interiorly thereof.

SUMMARY OF THE INVENTION

The present invention has as its object the further accomodation of the above-noted practice selections and existing practices in the related industries.

In attaining this and other objects, the invention provides closures generally of the type described in the referenced copending applications, but differing therefrom in the introduction of a compressible layer, e.g., a foam layer, in the tamper-indicating means affording more expeditious manufacture of closures of type including both tamper indication and the customary glassine ambient isolation layer. Thus, the present invention provides a container closure having a closure member defining container closing expanse, means in the closure interiorly of the closure member for providing tamper indication and means movable with the closure member for both retaining the tamper-indicating means with the closure and for selectively rupturing the tamper-indicating means, such movable means being inaccessible through the closing expanse of the closure member and the closure affording visibility exteriorly thereof of the tamper-indicating element, wherein the tamper indication means includes a compressible layer and the movable means has at least the major extent thereof situate within the compressible layer.

In a particularly preferred embodiment, a telltale laminate comprises a glassine wafer, a layer of foam thereon and a foil layer overlying the foam. An assembly tool in the form of a rigid backing member of metal is applied to the glassine wafer and the laminate is thereby forced into the closure member and onto tines depending from the closure member interior upper surface. The tines pierce the foil layer and enter the foam and are so worked by the presence of the rigid backing member that the entirety of the tines remains in the foam layer, with ends of the tines distorted into retentive engagement with the foam layer. The glassine wafer remains with its original integrity after the laminate insertion step is practiced and may be adhered to a container by a glue interface when the closure is secured to the container.

The foregoing and other objects and features of the invention will be further evident from the following detailed description thereof and from the drawings wherein like reference numerals identify like parts throughout.

DESCRIPTION OF PREFERRED EMBODIMENTS AND PRACTICES

Figure 2:
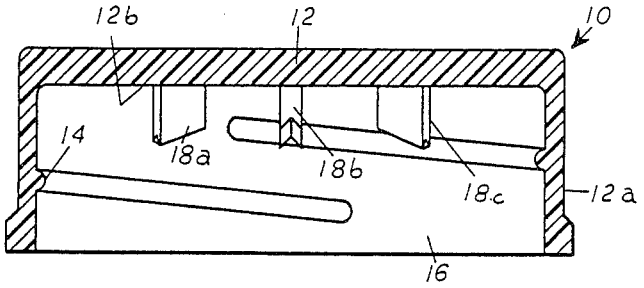
FIG. 2 is a front sectional elevation of the FIG. 1 closures as seen from section line II—II of FIG. 1.
Figure 1:
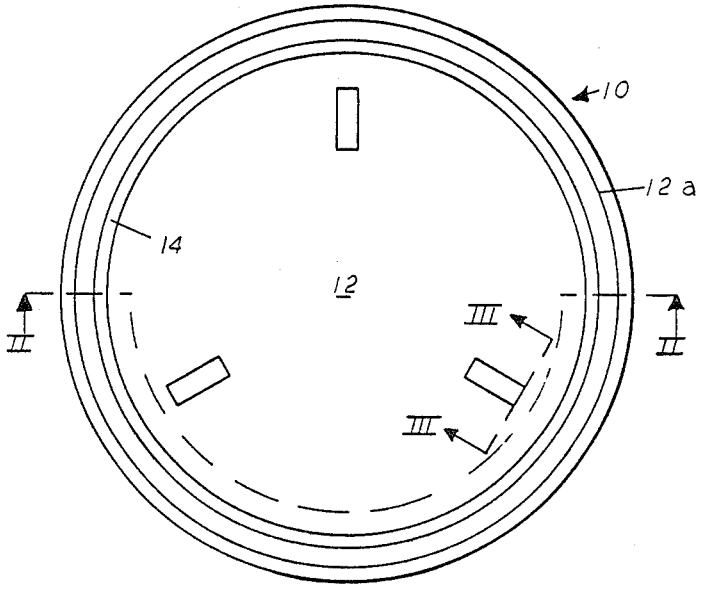
FIG. 1 is a plan elevation of a first embodiment of closure in accordance with the invention.

Referring to FIGS. 1 through 4, closure or cap 10 includes a closure member 12 having depending skirt **12*a* and interior threading 14 with lower opening 16. The cap defines closing expanse comprising skirt 12*a* and the undersurface 12*b* of cap 10**, for registry with the neck and mouth (now shown) of a jar or like container having an access opening for obtaining its contents.

Interiorly of such closing expanse, cap 10 includes one or more tines, three being shown as **18*a*, 18*b* and 18*c*, comprising puncturing and tearing or rupturing elements spaced at equal angles. Each tine may be formed integrally with cap 10, e.g., is molded therewith, and is rigid, such that it is not readily deflectable relative to cap undersurface 10*a*. As is discussed in the Ser. No. application, the tines may be parts of an insert to cap 10, which is secured therein for movement therewith. Based upon its secured relation to cap 10**, each tine travels with the cap in the course of its first sense (clockwise) movement into releasably secured relation with the jar neck and also in the course of second opposite sense (counterclockwise) cap movement relative to the jar for release from such secured relation therewith.

Cap 10 is desirably formed of optically clear plastics of butyrate, acetate, nylon, lucite and plexiglass and the like. The jar for use with cap 10 is preferably made of thermoplastics such as by use of a hypodermic needle. High impact styrene is suitable.

Figure 4:
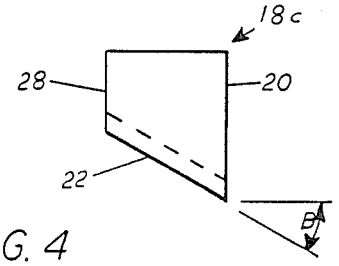
FIG. 4 is a side elevation of the FIG. 3 tine.
Figure 3:
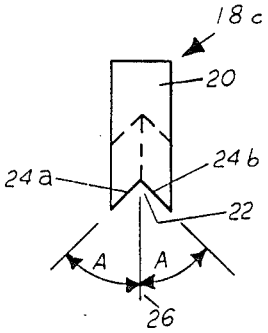
FIG. 3 is an elevation of a tine of the FIG. 1 closure as seen from plane III—III of FIG. 1.

Considering the configuration of tine **18*c*, shown in FIGS. 3 and 4, same includes a vertically extending radially outward wall 20, terminating in inverse V-shaped groove or rupturing channel 22**, bounded by surfaces 24*a* and 24*b*, each forming angle A (forty-five degrees) with the central vertical axis 26 thereof. The channel extends radially inwardly and upwardly to interior wall 28 at angle B (thirty degrees).

Figure 5:
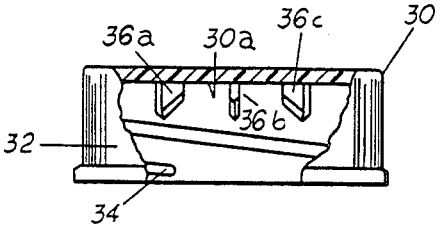
FIG. 5 is a front elevation, partly broken away, of another embodiment of closure in accordance with the invention.

Referring now to FIG. 5, cap 30 has skirt 32, interior threading 34, interior cap undersurface 30*a* and supports tines 36*a*, 36*b* and 36*c*, extending in the direction of lower opening 38.

It will be observed that each of tines 18*a–c* and 36*a–c* is radially offset from the center of the rotative movements of caps 10 and 30 and that each extends generally parallel to the axis of the hollow cylindrical cap. Each tine is also disposed radially of the rotation center, thus having extent generally radial to provide a frontal expanse for rupturing or tearing of a member penetrated thereby.

Figure 9:
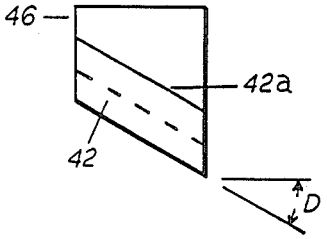
FIG. 9 is a side elevation of the FIG. 8 tine.
Figure 8:
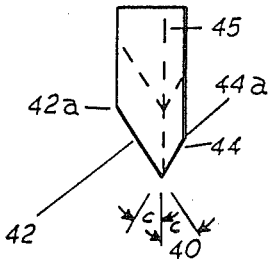
FIG. 8 is an elevation of a tine of the FIG. 5 closure as would be seen from plane III—III of FIG. 1.

In FIGS. 8 and 9, the configuration of tines 36*a–c* will be seen to involve an asymmetry about axis 40. V-shaped configuration is defined by tapered sidewalls 42 and 44, the former starting its taper at location 42*a*, higher than that 44*a* for the latter. Both taper at angle C (thirty degrees) and incline radially inwardly upwardly from outward wall 45 to interior wall 46 at angle D (thirty degrees). The asymmetry gives rise to a preferential directional deformation of tines as indicated for tine 36*c* in FIG. 10 upon assembly as now discussed.

Figure 6:
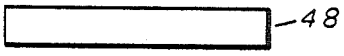
FIG. 6 is generalized showing of tamper-indicating means for insertion in the closures of FIGS. 1 or 5.
Figure 7:
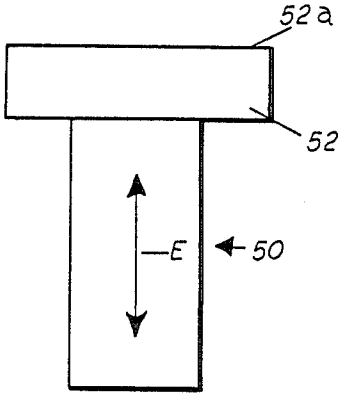
FIG. 7 shows an application tool for use in inserting the FIG. 6 tamper-indicating means in a closure.

Referring to FIG. 6, tamper indication means 48 is a generally flat disk which may be comprised of a layer of foam alone, e.g., styrene based plastic foam. Assembly tool 50 (FIG. 7) includes a backing member 52, being rigid in practice under present discussion, e.g., a metal cylinder, for receiving layer means 48 on its upper surface 52*a* and is movable in direction E for inserting layer means 48 into opening 38 of cap 30.

Figure 10:
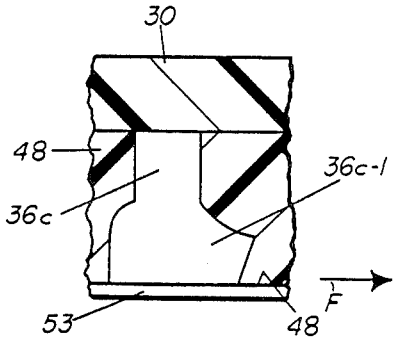
FIG. 10 is a partial sectional view as would be seen from the FIG. 8 perspective of one assembly of the FIG. 5 closure and a tamper-indicating element.

FIG. 10 shows the assembly resulting from such insertion practice with a rigid backing member. In this assembly, the entirety of tine 36*c* is situate in layer means 48, with end portion 36*c*-1 of the tine positioned in spaced relation to layer means undersurface 48*a* and with the tine defining a generally hooked shape at its end portion 36*c*-1, such hook being in retentive relation to layer means 48 and extending in direction F, i.e., the direction of opening movement (counterclockwise rotation) of cap 30. As such, the tine is disposed to enhance tearing of layer means 48 in the course of opening movement of cap 30 and accordingly is adapted to heighten tamper indication. As is also evident from FIG. 10, tine 36*c* is so deformed that reuse of the cap by a would-be tamperer is negated.

Layer means 48 may carry on its undersurface a marginal ring 53 of contact-activated adhesive, or same may be applied to the jar mouth, whereby the FIG. 10 assembly has jar securement. With tine 36*c* spaced from such undersurface, ruptured fragments of layer means 48 may be removed upon container opening without entering the container.

Figure 11:
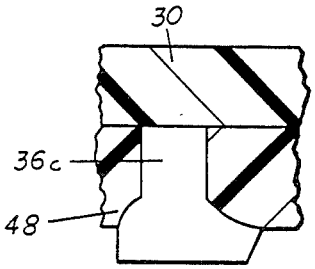
FIG. 11 is a partial sectional view as would be seen from the FIG. 8 perspective of another assembly of the FIG. 5 closure and a tamper-indicating element.

Backing member 52 may, if desired, be a compressible member, e.g., rubber, to reach the assembly shown in FIG. 11. Here, a major extent of tine 36*c* is situate in layer means 48 (more than half of its vertical extent), thus enhancing telltale rupture. Retention is effected by the remnant of tine 36*c* exteriorly situated with respect to layer means 48.

In the practices of assembly discussed in connection with FIGS. 10 and 11, a bond is exhibited within layer means 48 as between same and the penetrating tine. Thus, with the tine constituted by a plastic which is styrene or like based and the foam like based, the working of the tine by insertion force of a rigid backing member gives rise to a plastic to plastic bond as between the tine and foam, thus providing a barrier to ambient environment penetration through the assembly as contrasted with the situation which would exist in the absence of such sealing action.

Figure 12:
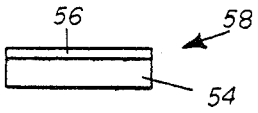
FIG. 12, 14 and 16 show varieties of tamper-indicating laminates for use in practicing the invention.
Figure 13:
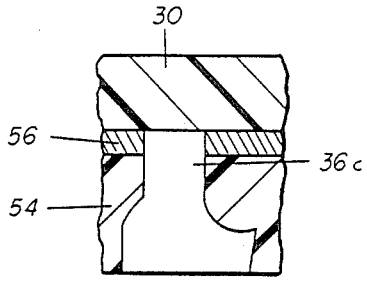
FIGS. 13, 15 and 17 show partial sectional views as would be seen from the FIG. 8 perspective of assemblies of the FIG. 5 closure and the laminates of FIGS. 12, 14 and 16, respectively.
Figure 14:
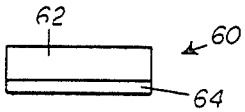
Figure 16:
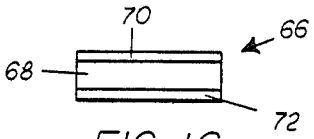

While the telltale or tamper indication means has been discussed as constituted by foam for layer means 48, the invention contemplates various other telltales, some of which are seen in FIGS. 12, 14 and 16. In FIG. 12, the telltale comprises foam layer 54 in assembly with overlayer 56 of metal foil, defining laminate 58. Practice of the FIG. 10 method, i.e., rigid backing member, gives rise to the assembly of FIG. 13, wherein tine 36*c* penetrates and is thus situate in both layers of the laminate.

Figure 15:
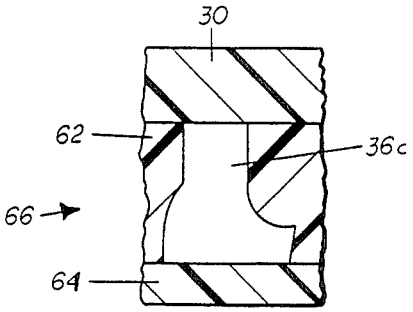

In FIG. 14, the laminate 60 comprises foam layer 62 and underlayer 64 constituting a container access port seal, e.g., glassine or like sealing layer. The assembly of FIG. 15 results, when the method of FIG. 10 is used, i.e., tine 36*c* penetrates and is resident in layer 62 and spaced from layer 64 and hence not violative of the integrity thereof.

Figure 17:
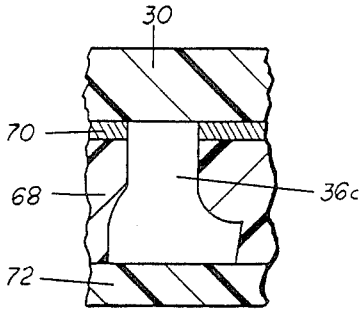

In FIG. 16, the laminate 66 comprises foam layer 68 together with metal foil layer 70 intervening layer 68 and cap undersurface 30*a* and secured to one surface of layer 68, and with underlying glassine layer 72 secured to the side of layer 68 opposite such one surface thereof. In the resulting assembly (FIG. 17), again under the method of FIG. 10, tine 36*c* penetrates the metal foil layer 70 and foam layer 68 and is spacedly disposed relative to the glassine underlayer 72, which is securable to the jar mouth as above described.

Figure 19:
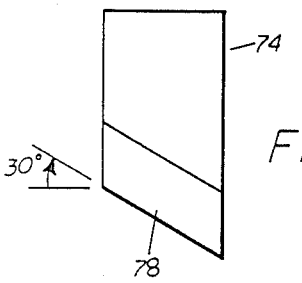
FIG. 19 is a side elevation of the FIG. 18 tine.
Figure 18:
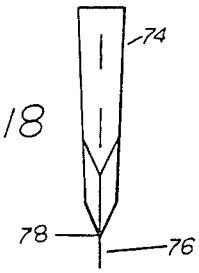
FIG. 18 is an elevation of a further embodiment of tine for use in practicing the invention.

Tines may take the further configuration shown in FIGS. 18 and 19. Here, tine 74 is symmetrical about axis 76 and defines piercing apex 78 inclined radially inwardly upwardly between end walls 80 and 82.

In the embodiments of FIGS. 14 and 16, the upper surfaces of container access port sealing layers of glassine or like dense paper are provided with coloration, e.g., bright red, and the foam layers are of offset color, e.g., white, whereby a vivid telltale indication is provided as the closure member is rotated in the opening direction. With the major extent of the rupturing tearing tines effectively embedded in the foam layer, surety of tamper indication is effected. In fact, the securement aspect, whereby an interior glassine wafer is captured in a closure member through its adhesion to the captured foam gives the methods of the invention utility in non-tamper indication applications, i.e., where it is desired to avoid customary release of container access port sealing layers from caps in shipment and handling.

Various changes in structure and modifications in practice may evidently be introduced in the foregoing particularly disclosed and described embodiments and method without departing from the invention. Thus, such matters as closure configuration, tine structure, telltale selection and the like will be seen to be readily varied.

The preferred embodiments and practices are thus intended in an illustrative and not in a limiting sense. The true spirit and scope of the invention is set forth in the following claims.

What is claimed is:

1. A container closure having a closure member defining container closing expanse, means in said closure interiorly of said closure member for providing tamper indication and means dependent from said closure member and movable with said closure member for both retaining said tamper indication means with said closure and for selectively rupturing said tamper indication means, such movable means being inaccessible through said closing expanse of said closure member and said closure affording visibility exteriorly thereof of said tamper indication means, such tamper indication means including a compressible layer, said movable means having a first extent adjacent said closure member and a second extent distal from said closure member, said second closure member extent being enlarged with respect to said first closure member extent and being in retentive residence within said compressible layer.

2. The closure claimed in claim 1 wherein said movable means second extent has an end situate within said compressible layer.

3. The closure claimed in claim 2 wherein said tamper indication means comprises an assembly of said compressible layer and a further layer secured to one side of said compressible layer and intervening said closing expanse and said compressible layer.

4. The closure claimed in claim 3 wherein such tamper indication means assembly further includes a container access port sealing layer secured to the side of said compressible layer opposite said one side thereof.

5. The closure claimed in claim 2 wherein said tamper indication means comprises an assembly of said compressible layer and a container access port sealing layer secured to said compressible layer.

6. The closure claimed in claim 1 wherein said moveable means second extent has and end situate exteriorly of said compressible layer.

7. The closure claimed in claim 6 wherin said tamper indication means comprises an assembly of said compressible layer and a further layer secured to one side of said compressible layer and intervening said closing expanse and said compressible layer.

8. The closure claimed in claim 1 wherein said movable means comprises at least one retaining-rupturing member extending from said closure member into engagement with said tamper indication means.

9. The closure claimed in claim 8 wherein said closure member is adapted for rotative first and second movements of respectively opposite sense and wherein said retaining-rupturing member is radially offset from said center of such first and second movements.

10. The closure claimed in claim 8 wherein said retaining-rupturing member is integral with said closure member.

11. The closure claimed in claim 8 wherein said closure member is a hollow cylinder having an open end, said retaining-rupturing member extending generally parallel to the axis of said cylinder and radially offset therefrom.

12. The closure claimed in claim 1 wherein such movable means and such tamper indication means exhibit a mutual bond therebetween.

13. The closure claimed in claim 1 wherein such tamper indication means comprises a plastic foam layer and wherein said movable means is comprised of plastic material bondable to said foam layer plastic.

14. A method of providing a tamper-indicating closure of type including a closure member for first sense movement relative to a container into securement therewith and in circumscribing relation to a container access opening and for second sense movement for release from such securement, said method comprising the steps of:

(a) disposing a retaining member interiorly of said closure member and restraining said retaining member for travel with said closure member;

(b) forming a secured assembly of a tamper-indicating element and a compressible layer; and (c) applying a backing member to said assembly and forcing said assembly into such closure member interior and onto said retaining member, said backing member being selected such that, in the resulting closure, the retaining member is deformed and thereby retentively captured by said compressible layer.

15. The method claimed in claim 14 wherein said step (a) is practice by forming said retaining member integrally with said closure member.

16. The method claimed in claim 14 wherein said step (b) is practiced by selecting foam for said compressible layer.

17. A method of providing a tamper-indicating closure of type including a closure member for first sense movement relative to a container into securement therewith and in circumscribing relation to a container access opening and for second sense movement for release from such securement, said method comprising the steps of:

(a) disposing a retaining member interiorly of said closure member and restraining said retaining member for travel with said closure member;

(b) forming means for providing tamper-indication; and (c) applying such tamper-indicating means to be backing member therefor and forcing said backing member into such closure member interior thereby to place said tamper-indicating means onto said retaining member and deforming said retaining member, said backing member being selected such that, in the resulting closure, deformed extent of such retaining member is resident at least in part in said tamper-indicating means.

18. The method claimed in claim 17 wherein said step (c) is practiced in part by selecting said backing member to include a rigid end portion by applying said tamper-indicating means to a flat end surface of said end portion and displacing said end portion into said closure member interior axially of said closure member.

19. The method claimed in claim 18 wherein said retaining member is configured to have preferential directional deformation in the course of practice of said step (c).

20. The method claimed in claim 17 wherein said step (c) is practiced in part by selecting said backing member to include a resilient end portion, by applying said tamper-indicating means to a flat surface of said end portion and by displacing said end portion into said closure member interior axially or said closure member.

21. The method claimed in claim 20 wherein said retaining member is configured to have preferential directional deformation in the course of practice of said step (c).

22. A container closure having a closure member defining container closing expanse, rupturing and tearing means secured within said closure member and moveable therewith, and a tamper-indicator comprising a first layer for receiving and retaining said rupturing and tearing means and a second layer of container access port sealing character having a surface thereof secured to said first layer, said second layer being adapted to deform said rupturing and tearing means, to effect such residence of said rupturing and tearing means in said first layer and to retain second layer sealing integrity upon said residence of said rupturing and tearing means in said indicator, said second layer including means on said surface thereof for providing tamper indication.

23. A container closure for first and second opposite sense movements with respect to a container and having a closure member defining container closing expanse, a multilayer assembly in said closure including a first layer and a second layer, said second layer being secured to said first layer and being of container access port sealing character, and rupturing means for movement with said closure member and for retaining said multilayer assembly with said closure, said rupturing means having asymmetric expanses in said first layer extending respectively in the directions of said first and second opposite sense movements of said closure.

24. The closure claimed in claim 23 wherein said first layer has one surface adjacent said closure member container closing expanse and a second surface secured to said second layer, said asymmetric expanses of said rupturing means being adjacent said second surface of said first layer and spaced from said first surface of said first layer.

25. The closure claimed in claim 24 wherein said rupturing means is of boot-like configuration within said first layer.

* * * * *